United States Patent [19]

Massoudi

[11] Patent Number: 4,923,335

[45] Date of Patent: May 8, 1990

[54] PROCESS AND DEVICE FOR THE PRODUCTION OF A MARINE ENGINEERING STRUCTURE, SUCH AS A PIER, JETTY AND THE LIKE

[75] Inventor: Ahmad Massoudi, Tehran, Iran

[73] Assignee: Darya Paye Jetty Co., Ltd., United Kingdom

[21] Appl. No.: 324,209

[22] Filed: Mar. 15, 1989

[30] Foreign Application Priority Data

Mar. 17, 1988 [NL] Netherlands ..... 8800664

[51] Int. Cl.[5] ..... E02D 25/00

[52] U.S. Cl. ..... 405/204; 405/195; 405/209; 405/222; 405/223

[58] Field of Search ..... 405/203, 204, 195, 208, 405/209, 222, 223

[56] References Cited

U.S. PATENT DOCUMENTS

| | | | |
|---|---|---|---|
| 1,758,606 | 5/1930 | Jacobs | 405/222 |
| 3,703,207 | 11/1972 | Horton | 405/203 X |
| 4,054,034 | 10/1977 | Hyre et al. . | |
| 4,187,038 | 2/1980 | Taylor | 405/204 |
| 4,468,156 | 8/1984 | Davis et al. | 405/222 |

FOREIGN PATENT DOCUMENTS

| | | | |
|---|---|---|---|
| 0231134 | 8/1987 | European Pat. Off. . | |
| 1210952 | 3/1960 | France | 405/204 |
| 1338500 | 8/1963 | France . | |
| WO/8703026 | 5/1987 | PCT Int'l Appl. . | |
| 956386 | 4/1964 | United Kingdom . | |
| 1325640 | 8/1973 | United Kingdom . | |

*Primary Examiner*—Dennis L. Taylor
*Assistant Examiner*—John A. Ricci
*Attorney, Agent, or Firm*—Brumbaugh, Graves, Donohue & Raymond

[57] ABSTRACT

The invention relates to a process and a floating apparatus (1, 2, 18) for the construction of columnlike elements (16, 17), forming part of a pier, a jetty or the like marine structure, in which a first part (16) is manufactured on a support (5) attached to the floating apparatus. Whilst said apparatus rests on the waterbottom (15), which first part (16) is lowered on the waterbotton (15) after lifting the floating apparatus to free it from the waterbottom and after displacement to a place with deeper water. There the next part (17) is made upon the still deeper water, lowered again until they rest on the bottom, after which the next part is made and so on until the final height and destination are reached. The floating apparatus is completely equiped (10, 11, 14) for performing the work and has a construction such, that it can be disengaged from the finished structure.

8 Claims, 2 Drawing Sheets

10659

PROCESS AND DEVICE FOR THE PRODUCTION OF A MARINE ENGINEERING STRUCTURE, SUCH AS A PIER, JETTY AND THE LIKE

The invention relates to a process for the production of a marine engineering structure, such as a pier, a jetty, a reservoir etc., on a water bottom by placing on the water bottom a double-walled hollow column whose base is broader than the part running up from it, and whose hollow wall is filled with setting material, such as concrete, during or after the positioning thereof, said column being placed on the water bottom from a floating apparatus.

International patent application WO 87/03026, laid open for inspection, describes the production of a double-walled hollow column of polygonal cross section and having a broad base with sharp bottom edge and of polygonal horizontal section, said base tapering upwards into a narrower central part which is jointed by a top part. This column can be taken on a floating apparatus, such as a barge provided with a crane, to its destination and lowered there, the hollow wall being filled with concrete, and anchoring in the bottom water being obtained by the column being placed deep enough in the water bottom under the influence of gravity and with the aid of excavation means.

This hollow column is made of parts prefabricated near the work to be produced, i.e. on the bank, said parts being connected together on site by connecting means such as bolts and welds.

The principle of the column which is known per se, and which has already proved suitable for the production of jetties and dams, permits a relatively cost-effective production method.

However, if one has to contend with extensive building projects where the dimensions are great in the horizontal plane and in the vertical direction, the production of these columns on the bank begins to give rise to problems. This also applies to the placing of the finished hollow column on the floating apparatus and lowering the column therefrom onto the water bottom.

The object of the invention is therefore to produce a simple process by means of which it is possible to produce and place the column in a relatively cheap manner even where large dimensions are concerned.

This object is achieved according to the invention in that the floating apparatus used is a platform entirely designed as a workshop, with adjustable floating power and with a bottom edge or bottom which permits placing on the water bottom; the platform is placed in shallow water on the water bottom at the beginning of production of the column; a first part of the column, such as the base part, is then made there on a temporary support which is beside an opening or recess of the platform designed in such a way that the platform can be moved away from the ready column; after making of the first part of the column, the platform is moved to deeper water and the already finished part of the column is placed on the water bottom; all this taking place in such a way that the top part of the already finished part of the column remains accessible from the deck of the platform; a further part of the column is subsequently fitted and, unless this is the last part, the platform is moved again to yet deeper water and the column is lowered further, the already completed part of the column always being first lifted through regulation of the floating power of the platform and lowered after shifting; on completion of the column, which may or may not already be filled with concrete, it is lifted again by means of the platform and taken to its destination, where the column is finally lowered and fixed.

The invention is therefore based on the principle that one begins by making the column on a platform with adjustable floating power designed as a pontoon, which is placed on the water bottom, either by setting this pontoon on the bank at high water or near the bank lowering it onto the water bottom by reducing floating power, with or without the use of telescopic supporting legs which are known per se. Once a first part is made, using the advantage that it is still possible to have supplies from the bank, the pontoon is moved to slightly deeper water, and the already completed part of the column is placed on the water bottom. The next part of the column is then built on the already completed part, the column part then obtained is lifted by connecting to the pontoon and slightly increasing the floating power thereof, and one then travels to the next point where the column can be lowered again, in order to produce the then, for example, remaining part. When the column has been produced in this way, it is standing on a place on the water bottom which is not the correct one. The column can then be provided with a concrete filling depending on whether this is desirable. When the pontoon with the partially completed column has moved away from the bank, the advantage obtained during further construction on the column is that the part already standing on the water bottom forms an anchor point, despite the fact that further construction work is being carried out on it.

When the column is complete and the pontoon is lowered slightly, the latter is connected again to the column, and this column is lifted by increasing the floating power and then travelling to the destination, where the final positioning and anchoring can take place also from the pontoon, which still encloses the column with its opening or recess. The pontoon cannot move away until this work has been completed and the opening or recess has been opened.

The platform for carrying out the process according to the invention according to a first embodiment can comprise a pontoon which in the area of at least one side edge is provided with a recess which is open facing said side edge, and in which or near which there are means for temporarily supporting the first part of the column to be produced. In this embodiment the recess in the side edge is always open, so that the separation of pontoon and column can take place at any desired time.

Such a pontoon has, however, usually a somewhat limited working surface, for in order to be fully equipped for carrying out all work, the pontoon should have a concrete supply station with concrete guiding means, the raw materials for concrete such as water, sand, cement and gravel, a mobile crane, and also generators for producing energy in order to be able to supply power to the equipment, such as pumps, for positioning.

According to another embodiment of the platform according to the invention, it comprises two pontoons which are detachably connected to each other and in the connected state form a continuous working deck, and which beside the partial surface bound a recess which is open after uncoupling and moving apart of the pontoons and in or beside which there are means for temporarily supporting the first part of the column to be produced. When the two pontoons are connected, this embodiment provides a continuous large work surface, from which the column to be produced is accessible on all sides.

During the production of the column, in particular during the production of the base part, the opening or recess can be closed off by a removable cover, by supporting bars and the like. If this part is to be lowered via the recess or opening, the working crane preferably designed as a bridge crane is used, the column part is lifted with it and is then lowered after the covering is removed from the opening or recess.

According to the invention, it is, however, preferable that the means for temporarily supporting the first part of the column to be produced should comprise a body with adjustable floating power which fills the opening or recess. This body, which can be detachably coupled to the two pontoons, or to one pontoon, then has a top deck which will be flush or virtually flush with the deck of the pontoon(s). After production of the base part of the column, this body is lowered to below the pontoon, the finished column part is removed by means of the hoisting means, this body is removed, and then the column part can be lowered further until it rests on the water bottom.

It is, however, also possible to proceed in such a way that the ready column part is lowered with this body and is made to rest with it on the water bottom. After completion of the next column part, it is lifted by means of the pontoon from the body resting on the water bottom and travels to another place where the finished column part is lowered onto the water bottom. The body is then given more floating power, so that it is recovered and can be re-used.

It is conceivable to leave this body under the column until the latter is completed. It is essential that the height of the column should always be increased in stages, while the column always rests on the water bottom and can always be filled with concrete and then through its weight forms an anchoring place for the floating pontoon(s) being used as a workshop.

The invention will now be explained in greater detail with reference to the drawings.

Figure 4:
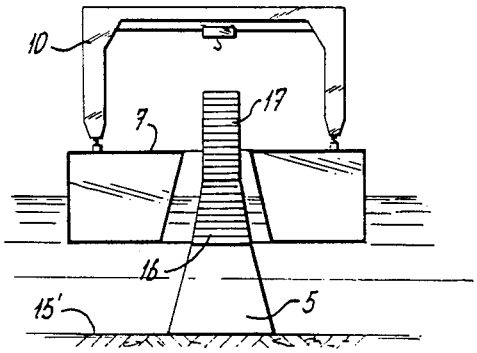

FIG. 4 serves to explain the process.

Figure 5:
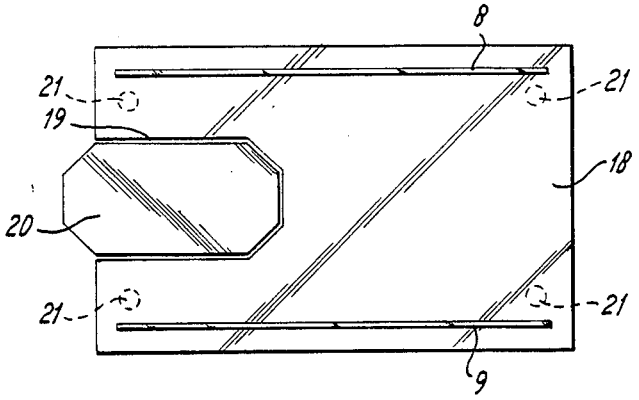

FIG. 5 shows a schematic top view of another embodiment of the device according to the invention.

Figure 6:
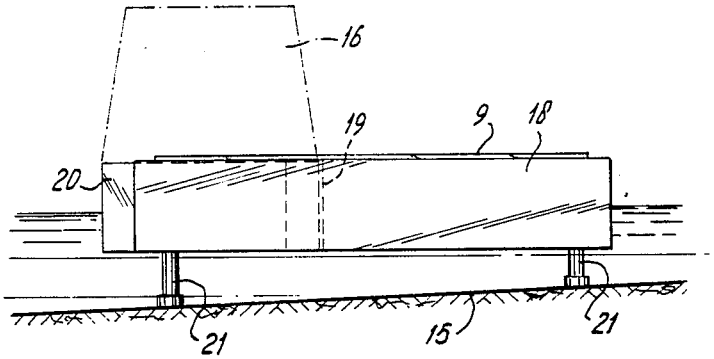

FIG. 6 shows schematically a side view of the device of FIG. 5.

Figure 7:
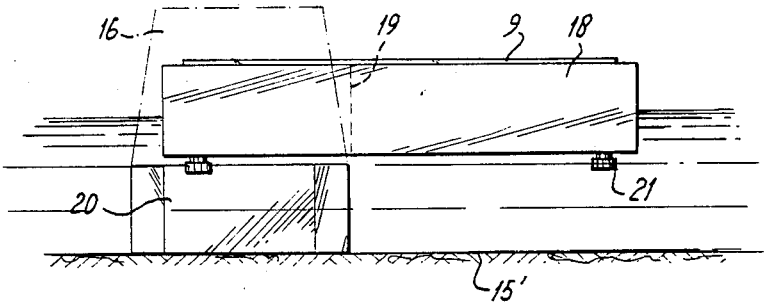

FIG. 7 shows the device of FIGS. 5 and 6 in another position to explain the process according to the invention.

Figure 1:
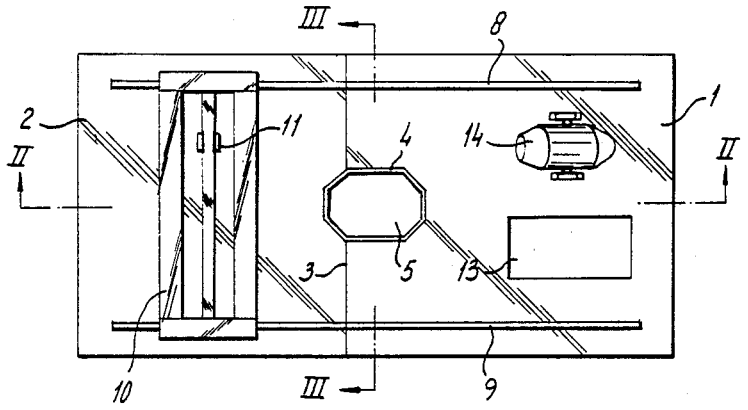
FIG. 1 shows in top view an embodiment of the device according to the invention for using the process according to the invention.
Figure 2:
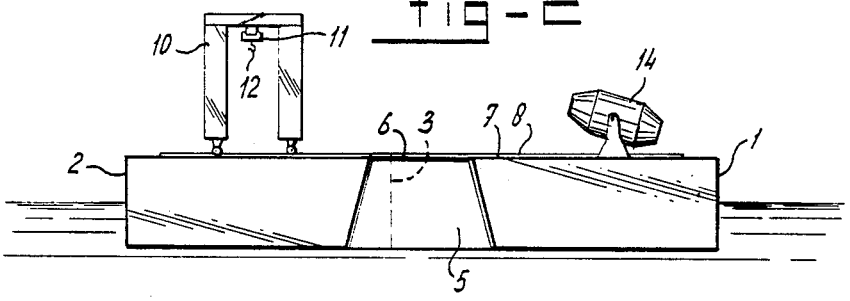
FIG. 2 is a cross section along the line II—II of FIG. 1 and shows the device of FIG. 1 also in schematic form.
Figure 3:
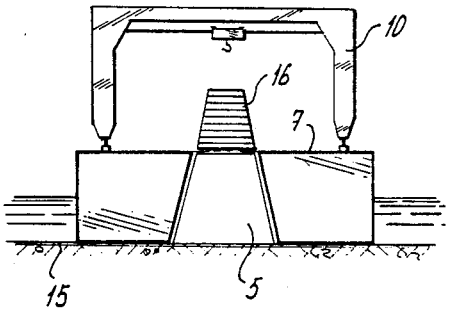
FIG. 3 is also a schematic cross section along the line III—III of FIG. 1.

The device shown in FIG. 1 comprises a pontoon having parts 1 and 2 which are attached to each other along the line 3 by means of detachable fastening means which are not shown. When connected to each other, these pontoon parts 1 and 2 enclose a recess 4 which is partly in pontoon 1 and partly in pontoon 2. When these two parts 1 and 2 are separated, the recess is open.

This recess contains a third body 5 with floating power, the top face 6 of which is essentially flush with the deck 7 of the two pontoons 1 and 2.

This deck has a rail track 8, 9 for a bridge or portal crane 10, which is shown only schematically, and which is provided with a travelling trolley 11 with hoisting means 12. The deck contains all other facilities which are necessary, indicated by the rectangle 13 and the schematically shown concrete mixer 14.

At the start of production of a column the pontoon 1, 2, 5 is placed on the water bottom 15, either directly or with supporting legs, as schematically indicated in FIG. 6. A first part 16 of the column to be produced is then produced or placed on the body 5. Through increasing the floating power or using the tide, the platform is then floated and travels to another place, as schematically shown in FIG. 4. The floating power of the part 5 is reduced there, so that the latter sinks and comes to rest, for example, on the bottom 15', but in such a way that the top side of the already produced column part 16 is approximately at the level of the deck 7, so that the next column part 17 can be produced or placed on top of this part.

After that there are various possibilities.

The part 5 can be removed and the column can be placed on the bottom 15' by means of the crane.

It is also possible to move to a slightly deeper level and lower the column further then, so that the next part can be placed on top of it.

After completion of the column and generally after filling of the hollow wall with concrete, the column is lifted by first of all taking the pontoons to a lower floating level, then connecting them to the column and after that lifting it using the floating power of the pontoons. The column is then taken to its destination and lowered, either with the aid of the crane or in combination with the crane, by reducing the floating power.

When the column is on the water bottom, it must penetrate deeply enough into it, and this work can also be carried out from the platform via the inside of the column, i.e. via the opening which is inside the inner wall of the hollow wall.

When the column is finally positioned, the pontoon parts 1 and 2 are separated from each other and they are moved away, following which the pontoons are taken back to the bank for the production of the next column.

If a series of columns has to be positioned, they can be placed at the correct distance from each other using a hinged parallelogram, as described in the earlier mentioned international patent application, which has been laid open for inspection. This frame can be connected to the existing column from the pontoon. This frame can also be coupled beforehand to the column already in position and given floating power at the free end, so that this frame can be connected to the new column as soon as the latter is brought in with the platform.

In the embodiment according to FIGS. 5 to 7 there is a single pontoon 18, which on one side edge has a recess 19 containing a body with adjustable floating power. The deck of the pontoon has the same installations as those indicated for the embodiment of FIGS. 1 to 4, of which only the rail tracks 8 and 9 are shown. The embodiment of FIGS. 5 to 7 is provided with telescopic legs 21 near the corners of the pontoon. With these legs the pontoon can be displaced horizontally on a sloping or uneven surface near the bank.

The body 20 is again used to produce the first column part 16 on it, said part subsequently, as shown in FIG. 7, being lowered by means of the body 20 onto the water bottom 15', following which a second part can be placed or produced on the first part of the column in the same way as described for the embodiment of FIGS. 1 to 4.

When the column is completed, it can be floated to its destination with the aid of the pontoon 18. When the positioning is completed, the pontoon can move away immediately, since the recess 19 is open.

I claim:

1. Process for producing a marine engineering structure such as a pier, jetty and the like on a water bottom by placing on the water bottom a double-walled hollow column having a base which is broader than the part extending upwardly from it and whose hollow wall is filled with a setting material, such as concrete, during or after the positioning thereof, said column being placed on the water bottom from a floating apparatus having adjustable floating power and providing a platform having a deck substantially entirely designed and equipped as a workshop and a bottom side which allows the platform to be placed on the water bottom, said platform having an opening therethrough which extends from its deck to its bottom side for allowing a column to be lowered via the opening and the platform to be moved away from a completed column, and having means mounted thereon for carrying and lowering a column, said process comprising the steps of:

(1) at the start of production of a column, placing the bottom side of said platform on the water bottom in shallow water of a first depth;

(2) constructing, on the deck of the platform, a first part of a column, such as its base, and displaceably supporting the completed first part beside the opening in the platform;

(3) floating the platform and the completed first part of a column to water having a second depth deeper than said first depth and there removing its support and lowering the completed first part through said opening until it is supported on the bottom of the deeper water, the depth of which is such that the top of the completed first part of the column is accessible from the deck of the platform;

(4) constructing, from the deck of the platform, a further column part on the top of the completed first part of the column;

(5) unless said further part is the last part of the column, connecting the carrying means to the column, regulating the floating power of the platform to lift the column from the water bottom, and floating the platform to yet deeper water and there lowering the already completed part of the column until it is supported on the bottom of the yet deeper water, the depth of which is such that the top of the completed further column part is accessible from the deck of the platform;

(6) repeating steps (4) and (5) until a column of desired height has been constructed, and thereafter connecting the carrying means to the completed bottom-supported column, regulating the floating power of the platform to lift the base of the column from the water bottom, floating the platform to its destination and there lowering and fixing the completed column on the water bottom, and (7) moving the platform away from the fixed column.

2. Process according to claim 1, wherein the platform to be used is a pontoon having side edges, and wherein the completed first part initially is supported on moveable means disposed in or near a recess-shaped opening formed in the area of at least one side edge of the pontoon which is open toward the outer side.

3. Process according to claim 1, wherein the platform to be used comprises two pontoons detachably connected to each other and when connected form a substantially continuous working deck, and wherein the completed first part initially is supported on moveable means disposed in or near a recess bounded by the two pontoons which is opened by disconnection and moving apart of the pontoons.

4. Process according to claim 2 or claim 3, wherein the moveable means for supporting the completed first part of a column is a body having adjustable floating power which normally fills the opening.

5. Apparatus for manufacturing and setting a column of the bottom of a body of water, said apparatus comprising:

a platform having adjustable floating power, said platform having side edges, an underside adapted to allow the platform to rest on the bottom of a body of water, a top side providing a substantially continuous working deck, and having an opening formed at one side edge thereof which extends from the top side to the bottom side;

equipment means necessary for the manufacture of a column mounted on said working deck;

moveable means disposed at said opening for supporting a first part of a column during manufacture thereof; and means supported on said platform for carrying and lowering through said opening an already manufactured part of a column.

6. Appartaus for manufacturing and setting a column on the bottom of a body of water, said apparatus comprising:

a platform having adjustable floating power and an underside adapted to allow the platform to rest on the bottom of a body of water, said platform comprising first and second pontoons detachably coupled to each other which when connected form a substantially continuous working deck and bound an opening which extends between the deck and the underside of the platform through which a completed column part may be lowered and which is opened by uncoupling and moving apart of the pontoons;

equipment means necessary for the manufacture of a column mounted on said working deck;

moveable means disposed at said opening for supporting a first part of a column during manufacture thereof; and means supported on said platform for carrying and lowering through said opening an already manufactured part of a column.

7. Apparatus according to claim 5 or claim 6, wherein said means for supporting a first part of a column during manufacture thereof comprises a body having adjustable floating power which normally fills said opening.

8. Apparatus according to claim 5 or claim 6, wherein said means for carrying and lowering means comprises a crane.

* * * * *